US007639217B2

(12) United States Patent
Shin

(10) Patent No.: US 7,639,217 B2
(45) Date of Patent: Dec. 29, 2009

(54) SCAN DRIVING CIRCUIT AND ORGANIC LIGHT EMITTING DISPLAY DEVICE USING THE SAME

(75) Inventor: Dong Yong Shin, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 569 days.

(21) Appl. No.: 11/513,414

(22) Filed: Aug. 29, 2006

(65) Prior Publication Data

US 2007/0052653 A1 Mar. 8, 2007

(30) Foreign Application Priority Data

Aug. 29, 2005 (KR) ..... 10-2005-0079605

(51) Int. Cl.
*G09G 3/30* (2006.01)

(52) U.S. Cl. ..... 345/76; 345/79; 345/98; 345/204

(58) Field of Classification Search ..... 345/76, 345/79, 98, 204
See application file for complete search history.

(56) References Cited

U.S. PATENT DOCUMENTS 6,972,743 B2 * 12/2005 Kim et al. ..... 345/76
7,119,770 B2 * 10/2006 Moon ..... 345/79
2005/0156856 A1 7/2005 Jang et al.

FOREIGN PATENT DOCUMENTS

KR 10-2005-0011849 1/2005

OTHER PUBLICATIONS

Korean Patent Abstracts, Publication No. 1020000055633 A, Published on Sep. 15, 2000, in the name of Kim et al.
Korean Patent Abstracts, Publication No. 1020000059298 A, Published on Oct. 5, 2000, in the name of Kim et al.
Korean Patent Abstracts, Publication No. 1020050011849 A, Published on Jan. 31, 2005, in the name of Han et al.

* cited by examiner

*Primary Examiner*—Richard Hjerpe
*Assistant Examiner*—Leonid Shapiro
(74) *Attorney, Agent, or Firm*—Christie, Parker & Hale, LLP

(57) ABSTRACT

Scan driving circuit having a number of stages coupled together in series and coupled with first and second lock signal input lines. Each of the stages receives a start signal or an output signal of a previous stage and includes a transfer unit, an inversion unit, and a buffer unit and produces the output signal. The output signal of each of the stages includes a low level signal, the low level signal of each stage is sequentially shifted by one half of the clock signal period with respect to the low level signal of a previous stage. The series of shifted low level signals form the scan signals output by the scan driving circuit for driving an organic light emitting display device.

14 Claims, 10 Drawing Sheets

P : Precharge Period

E : Evaluation Period

SCAN DRIVING CIRCUIT AND ORGANIC LIGHT EMITTING DISPLAY DEVICE USING THE SAME

CROSS-REFERENCE TO RELATED APPLICATION

This application claims priority to and the benefit of Korean Patent Application No. 10-2005-0079605, filed on Aug. 29, 2005, in the Korean Intellectual Property Office, the entire content of which is incorporated herein by reference.

BACKGROUND

1. Field of the Invention

The present invention relates to a driving circuit for an active matrix type display device, and more particularly to a scan driving circuit for driving pixel rows in an organic light emitting display device.

2. Discussion of Related Art

In general, an active matrix type display device, such as the organic light emitting display device, includes a pixel array arranged in a matrix pattern at cross over regions between data lines and scan lines.

Here, the scan lines include horizontal lines (i.e., row lines) of a display region (including the pixel array), and sequentially provide a predetermined signal, namely, a scan signal, from a scan driving circuit to the pixel array.

FIG. 1 is a block diagram showing a conventional scan driving circuit. With reference to FIG. 1, the conventional scan driving circuit includes a plurality of stages ST1 to STn, which are serially coupled to a start pulse SP input line. The start pulse SP may also be referred to as a start signal. The plurality of stages ST1 to STn sequentially shift a clock signal C in response to the start pulse SP to generate output signals SO1 to SOn, respectively. Each of second to $n^{th}$ stages ST2 to STn receives and shifts an output signal of a previous stage as a start pulse.

Accordingly, the stages generate output signals SO1 to SOn by sequentially shifting the start pulse SP, and provide the output signals to the pixel array.

FIG. 2 is a circuit diagram of a stage in the scan driving circuit shown in FIG. 1. FIG. 3 is an input/output waveform diagram of the stage shown in FIG. 2. Referring to FIG. 2 and FIG. 3, each stage of a scan driving circuit conventionally uses a master-slave flip-flop. When a clock clk is at low level, such a flip-flop continues to receive an input and maintains a previous output.

In contrast, when the clock clk is at high level, the flip-flop maintains an input signal In received when the clock clk is at the low level and outputs it as an output signal Out1, but no longer receives the input signal In.

In the aforementioned circuit, an inverter included in the flip-flop has a problem in that a static current flows when an input In to the inverter is at low level. Furthermore, in the flip-flop, the number of inverters receiving a high-level input is the same as that of inverters receiving a low-level input. Accordingly, the static current flows through one half of all the inverters in the flip-flop, thereby causing increased power consumption.

An inset in FIG. 2 shows a more detailed circuit for the inverter. A voltage value corresponding to a ratio of resistances connected between a power supply VDD (e.g., a first voltage source) and a ground GND (e.g., a second voltage source) determines a high level of an output voltage out of the inverter including transistors M1' and M2'. A low level of the output voltage out is set to be greater than the voltage level of the ground GND by a threshold voltage Vth of the transistor M2' used in the inverter circuit.

Due to characteristic deviations of the transistors, since levels of an input voltage is different according to the respective stage, in the case where the circuit of FIG. 2 is used, deviation occurs when the output voltage is at high level, with the result that the circuit may be erroneously operated.

Moreover, the deviation in the low level of the output voltage causes a deviation in on-resistance of an input transistor of an inverter included in the circuit of FIG. 2 to occur, thereby impacting a deviation in a high level of the output voltage. In particular, since a display panel of an organic light emitting display device uses a transistor having a large characteristic deviation, such a problem is more serious.

Further, in the inverter, an electric current flows through the input transistor to charge an output terminal, whereas the electric current flows through a load transistor to discharge the output terminal. Upon charging of the output terminal, a source-gate voltage of the load transistor is gradually reduced, and accordingly a discharge current is rapidly reduced. This causes the discharge efficiency to be deteriorated.

SUMMARY OF THE INVENTION

Accordingly, it is an aspect of the present invention to provide a scan driving circuit and an organic light emitting display device using the same, which reduce power consumption by removing a flow path of a static current from the scan driving circuit, and switch an output voltage from a negative power supply voltage to a positive power supply voltage using bootstrap, wherein the scan driving circuit includes a plurality of PMOS transistors and capacitors and is driven by 2-phase clock signal.

One embodiment of the invention includes a scan driving circuit for an organic light emitting display device. The scan driving circuit comprises a plurality of stages coupled together in series. Each stage is coupled to an input line for receiving an input signal and an output line and is coupled to first and second power supplies. A first stage among the stages is for receiving a start signal on the input line and each of the other stages has its input line coupled to the output line of a previous one of the stages having first and second clock terminals. Each of the stages comprises a transfer unit having a first transistor and a second transistor, the first transistor having a first terminal coupled to the input line, a gate coupled to the first clock terminal, and a second terminal coupled to a gate of the second transistor, the second transistor having a first terminal coupled to the second clock terminal. Each stage also includes an inversion unit having a third transistor, a fourth transistor, and a fifth transistor, the third transistor having a first terminal coupled to the input line and a gate coupled to the first clock terminal, the fourth transistor having a second terminal coupled to the second power supply and a gate coupled with the first clock terminal, the fifth transistor having a first terminal coupled to the first clock terminal, a second terminal coupled to a first terminal of the fourth transistor, and a gate coupled to a second terminal of the third transistor. Each stages also includes a buffer unit having a sixth transistor, the sixth transistor having a first terminal coupled to the first power supply, a second terminal coupled to the output line, and a gate coupled to the second terminal of the fifth transistor.

Another embodiment presents another scan driving circuit for an organic light emitting display device. The scan driving circuit comprises a plurality of stages coupled together in series. Each stage is coupled to an input line for receiving an input signal and an output line. A first stage among the stages is for receiving a start signal as the input signal at the input line and each of the other stages has its input line coupled to the output line of a previous one of the stages having first and second clock terminals and being coupled to first and second power supplies. Each of the plurality of stages comprises a transfer unit, an inversion unit, and a buffer unit. The transfer unit has a first transistor and a second transistor, the first transistor having a first terminal coupled to the input line, a gate coupled to the first clock terminal, and a second terminal coupled to a gate of the second transistor, the second transistor having a first terminal coupled to the second clock terminal. The inversion unit has a third transistor, and a fourth transistor, the third transistor having a second terminal coupled to the second power supply and a gate coupled to the first clock terminal, the fourth transistor having a first terminal coupled to the first clock terminal, a second terminal coupled to a first terminal of the third transistor, and a gate coupled to the second terminal of the first transistor. The buffer unit has a fifth transistor, the fifth transistor having a first terminal coupled to the first power supply, a second terminal coupled to the output line, and a gate coupled to the second terminal of the fourth transistor.

Another embodiment presents another scan driving circuit for an organic light emitting display device. The scan driving circuit has a plurality of stages coupled together in series, each receiving an input signal through a start signal input line or an output signal line of a previous one of the stages, each of the plurality of stages coupled with first and second clock signal input lines and outputting an output signal to the output line. A first clock signal and a second clock signal are respectively received through the first and second clock signal input lines have equal periods of a one time period. The one time period is divided into a first time period and a second time period. During the first time period the scan driving circuit performs a precharge operation for outputting the output signal having a high-level. During the second time period the output signal has a level corresponding to that of the input signal received during the first time period. The output signal of each one of the plurality of stages includes a low level signal, the low level signal of each one of the plurality of stages sequentially shifted by one half of the one time period with respect to the low level signal of the previous one of the stages.

Another embodiment presents an organic light emitting display device, comprising a display region having a plurality of pixels coupled to scan lines, data lines, and emission control lines, a data driving circuit for supplying a data signal to the data lines, and a scan driving circuit. The scan driving circuit of the organic light emitting display device may have one of the structures disclosed above.

BRIEF DESCRIPTION OF THE DRAWINGS

These and/or other aspects and features of the invention will become apparent and more readily appreciated from the following description of the exemplary embodiments, taken in conjunction with the accompanying drawings of which.

DETAILED DESCRIPTION

Figure 1:
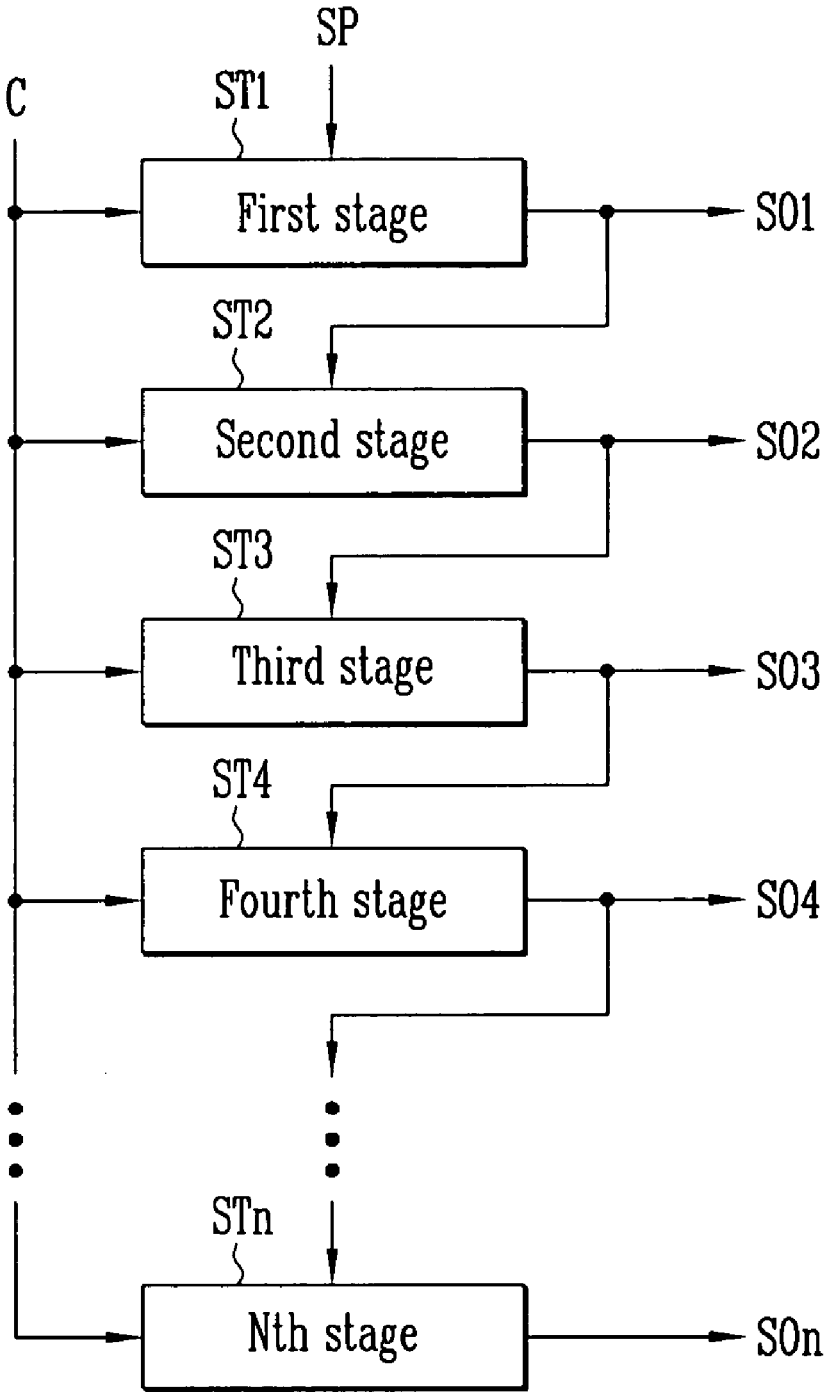
FIG. 1 (PRIOR ART)
FIG. 1 is a block diagram showing a conventional scan driving circuit.
Figure 2:
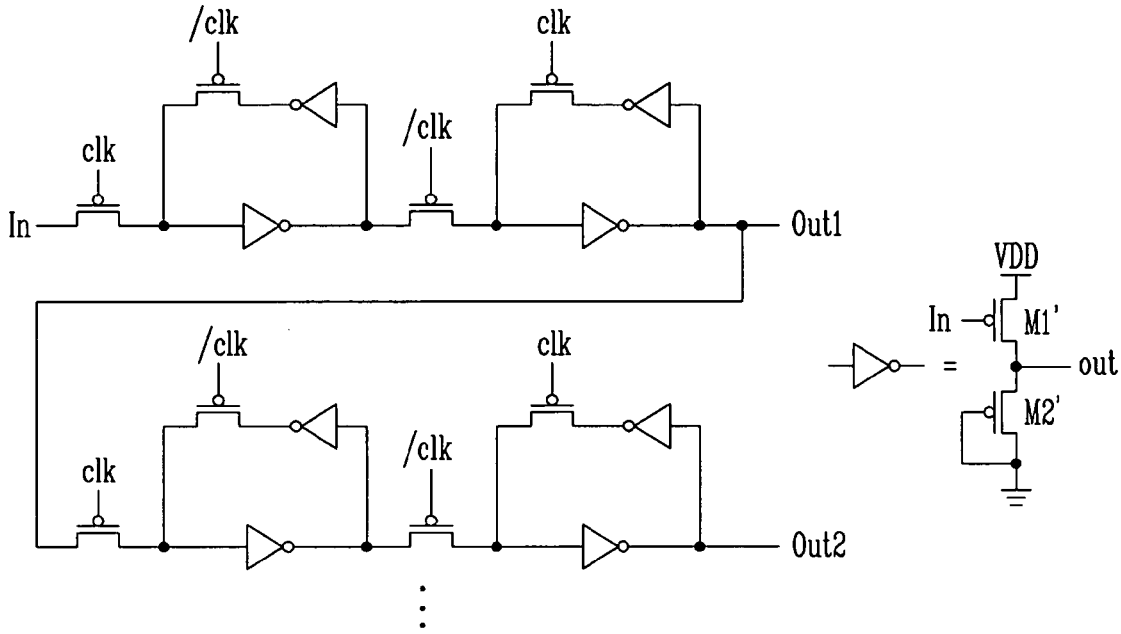
FIG. 2 (PRIOR ART)
FIG. 2 is a circuit diagram of a stage in the scan driving circuit shown in FIG. 1.
Figure 3:
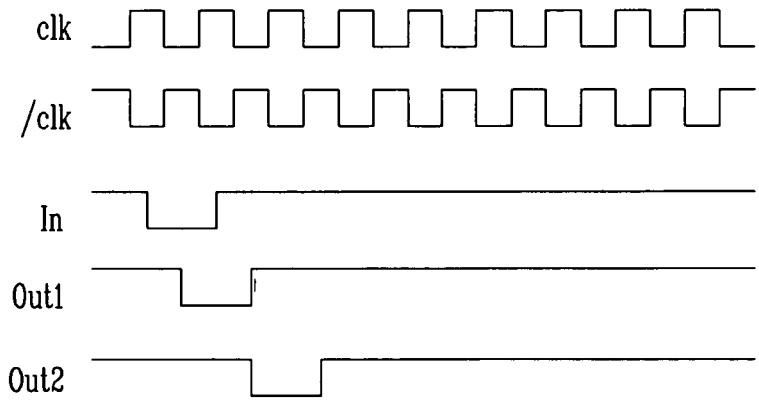
FIG. 3 (PRIOR ART)
FIG. 3 is an input/output waveform diagram of the stage shown in FIG. 2.

Hereinafter, exemplary embodiments according to the present invention will be described with reference to the accompanying drawings. Here, when one element is described as being connected to another element, the two elements may be directly connected or indirectly connected via one or more other elements. Further, some nonessential elements are omitted for clarity. Also, like reference numerals refer to like elements throughout.

Figure 4:
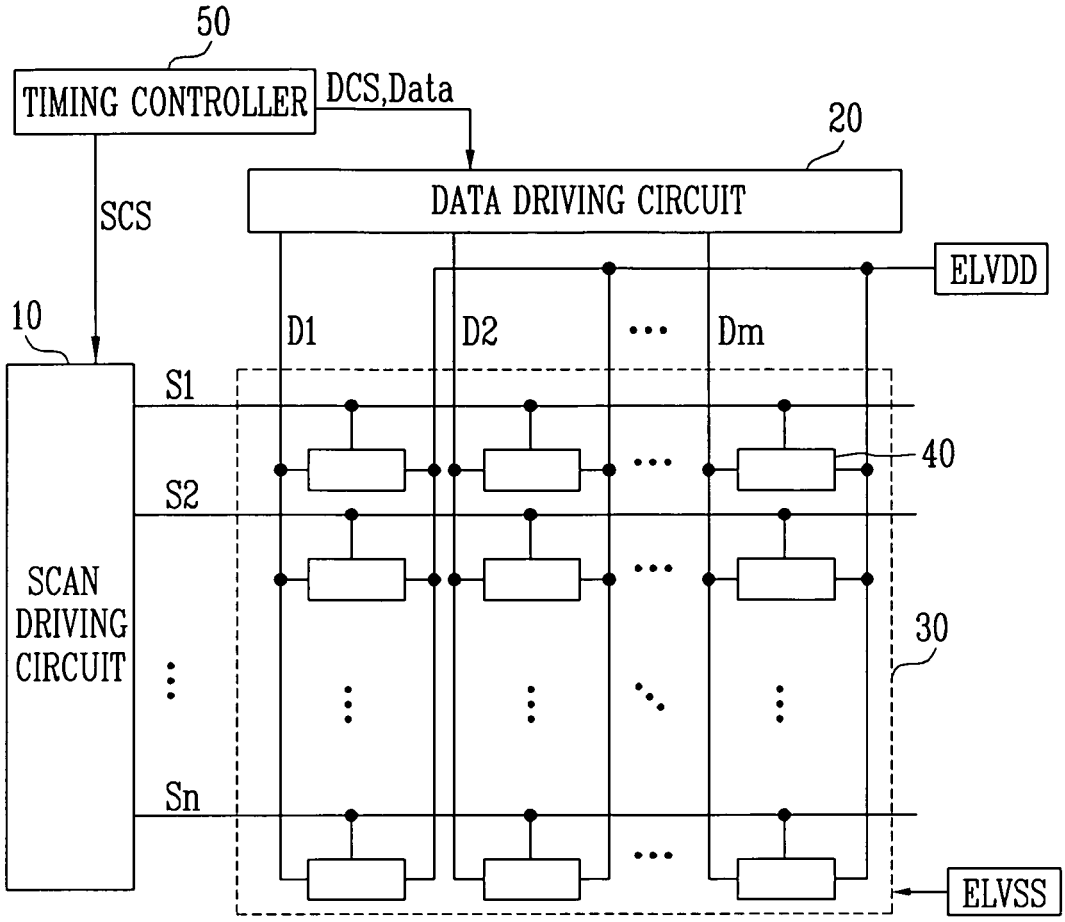
FIG. 4 is a block diagram showing an organic light emitting display device according to an embodiment of the present invention.

FIG. 4 is a block diagram showing an organic light emitting display device according to an embodiment of the present invention.

FIG. 4 is only an exemplary embodiment of the present invention and the organic light emitting display device of the present invention is not limited to that of FIG. 4.

With reference to FIG. 4, the organic light emitting display device includes a display region 30, a scan driving circuit 10, a data driving circuit 20, and a timing controller 50. The display region 30 includes a plurality of pixels 40 coupled with scan lines S1 to Sn and data lines D1 to Dm. The scan driving circuit 10 drives the scan lines S1 to Sn. The data driving circuit 20 drives the data lines D1 to Dm. The timing controller 50 controls the scan driving circuit 10 and the data driving circuit 20.

The timing controller 50 generates a data drive control signal DCS and a scan drive control signal SCS corresponding to externally supplied synchronous signals. The data drive control signal DCS and the scan drive control signal SCS generated by the timing controller 50 are provided to the data driving circuit 20 and the scan driving circuit 10, respectively. Further, the timing controller 50 provides an externally supplied data Data to the data driving circuit 20.

The data driving circuit 20 receives the data drive control signal DCS from the timing controller 50. When the data driving circuit 20 receives the data drive control signal DCS, it generates a data signal and provides the data signal to the data lines D1 to Dm synchronously with a scan signal.

The display region 30 receives a first voltage from a first power supply source ELVDD and a second voltage from a second power supply source ELVSS from external sources, and provides them to the pixels 40. Each of the pixels 40 controls an electric current flowing from the first power supply source ELVDD to the second power supply source ELVSS through an organic light emitting diode, thereby generating light corresponding to the data signal.

Furthermore, the scan driving circuit 10 receives the scan drive control signal SCS from the timing controller 50. When the scan driving circuit 10 receives the scan drive control signal SCS from the timing controller 50, it generates a scan signal and sequentially provides the scan signal to the scan lines S1 to Sn.

That is, in order to drive the plurality of pixels 40, the scan driving circuit 10 sequentially generates the scan signal and provides the scan signal to the display region 30.

Hereinafter, construction and operation of various exemplary embodiments of the scan driving circuit 10 of the organic light emitting display device according to the present invention will be explained.

Figure 5:
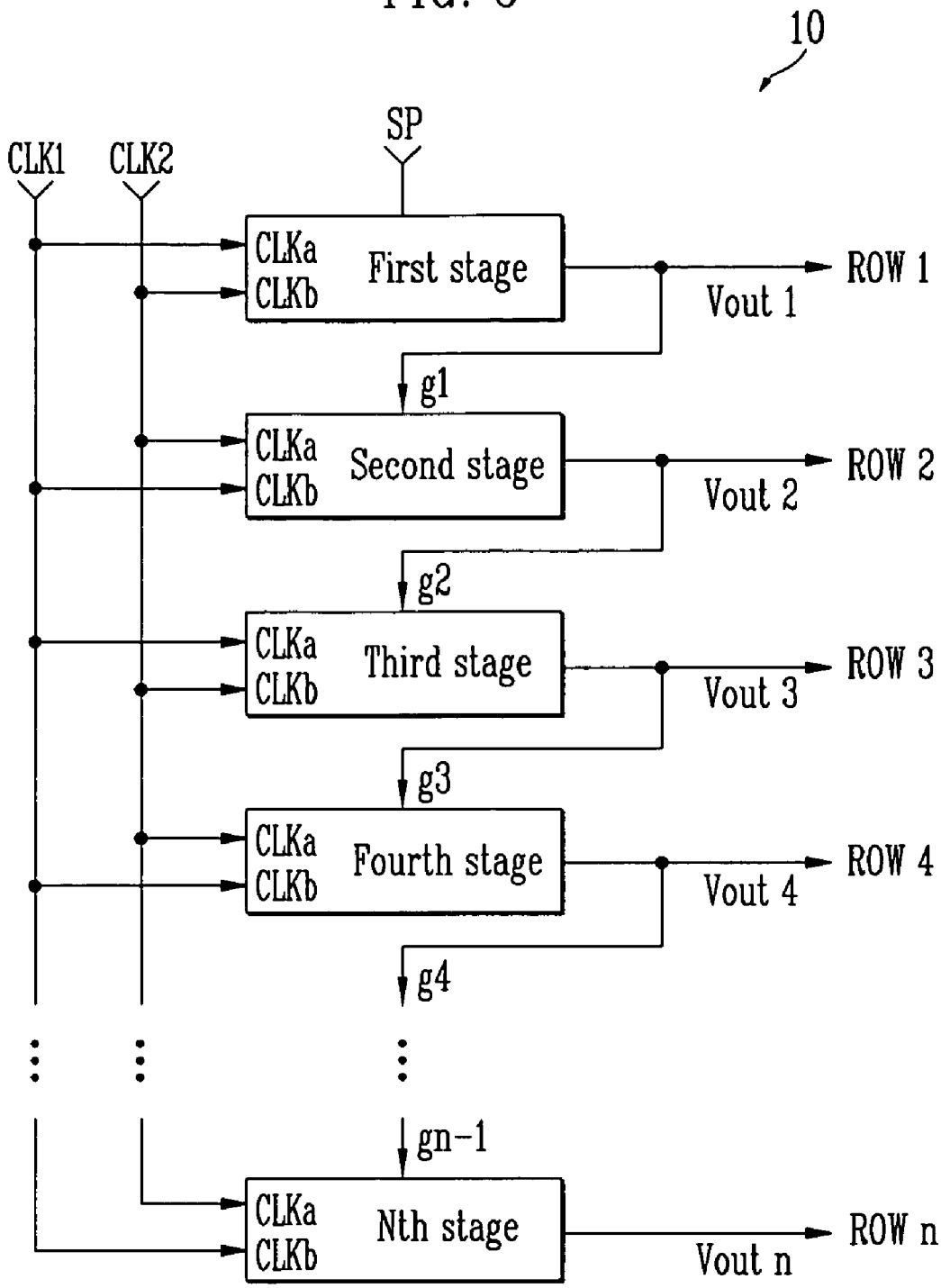
FIG. 5 is a block diagram showing a construction of a scan driving circuit according to an embodiment of the present invention.

FIG. 5 is a block diagram showing a configuration of a scan driving circuit 10 according to an embodiment of the present invention.

Referring to FIG. 5, the scan driving circuit 10 includes n stages that are serially coupled with a start pulse input line so as to drive an m×n pixel array where m and n are both natural numbers.

Output lines of the first n stages are coupled with first n row lines ROW1 to ROWn included in the pixel array. Output lines of the n stages of the scan driving circuit supply output voltages Vout1 through Voutn to the row lines ROW1 to ROWn. A start pulse SP is supplied to a first stage. Output signals Vout1 to Voutn-1 of first to (n-1)$^{th}$ stages are provided to their respective next stages as the start pulse $g_1$ to $g_{n-1}$. For example, the output signal $g_1$ of the first stage is supplied to the second stage as the start pulse for the second stage.

Further, each stage includes a first clock terminal CLKa and a second clock terminal CLKb. First and second phase-inverted clock signals CLK1 and CLK2 are supplied to the first clock terminal CLKa and the second clock terminal CLKb, respectively. The first clock signal CLK1 is supplied to the first clock terminal CLKa of odd-numbered stages in the scan driving circuit 10, and the second clock signal CLK2 is supplied to the second clock terminal CLKb. In contrast, the second clock signal CLK2 is supplied to a first clock terminal CLKa of even-numbered stages, and the first clock signal CLK1 is supplied to a second clock terminal CLKb of the even-numbered stages.

That is, when each stage receives the start pulse SP or the output signal $g_i$, alternatively called the output voltage Vouti, of a previous stage, and the first and second clock signals CLK1 and CLK2, it outputs a low logic pulse signal $g_{i+1}$ through an output line of the stage, thereby sequentially driving the display region 30 of the organic light emitting display device in rows.

Signals being input to the aforementioned scan driving circuit 10, that include the start pulse SP, the first and second phase-inverted clock signals CLK1 and CLK2, and a supply voltage (e.g., VDD, see FIG. 6), are supplied from an external control circuit.

Figure 6:
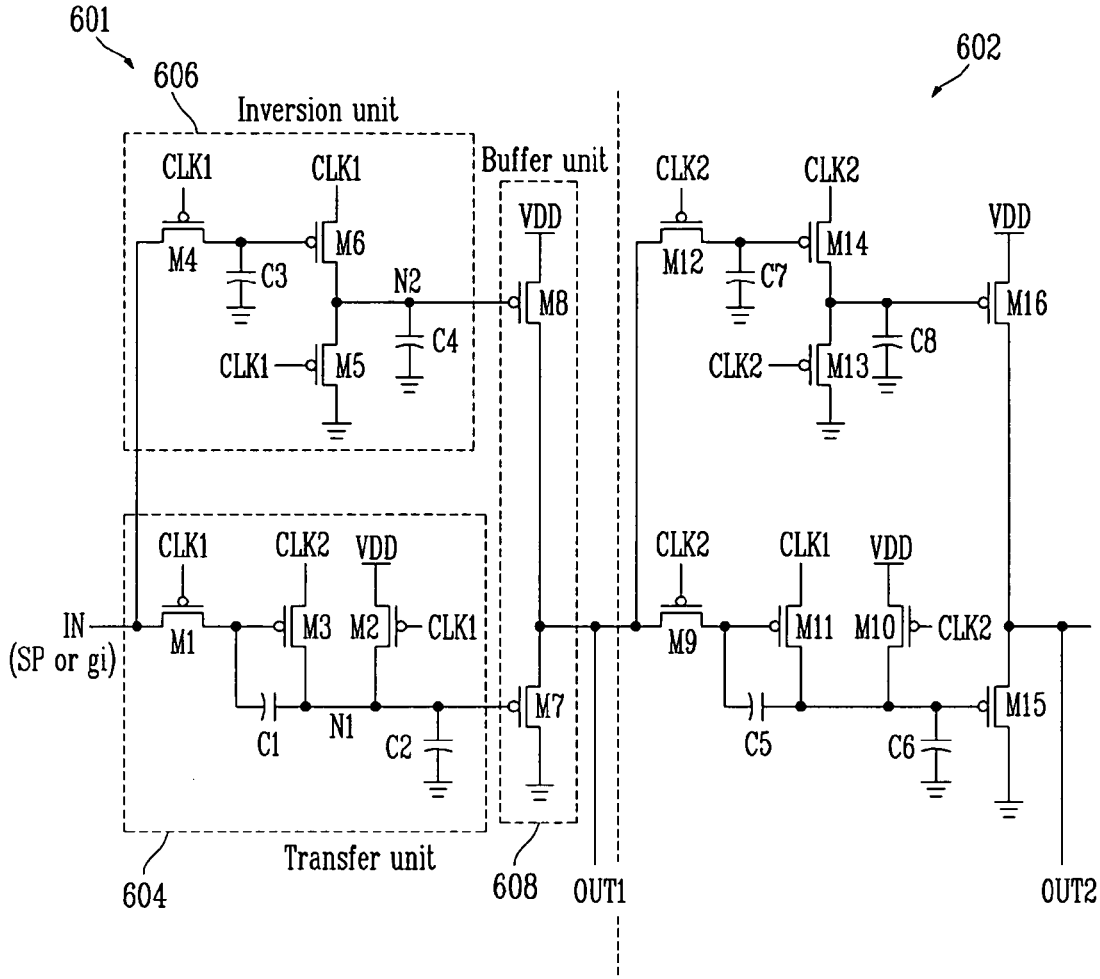
FIG. 6 is a circuit diagram showing odd and even stages of the scan driving circuit according to a first embodiment of the present invention.
Figure 7:
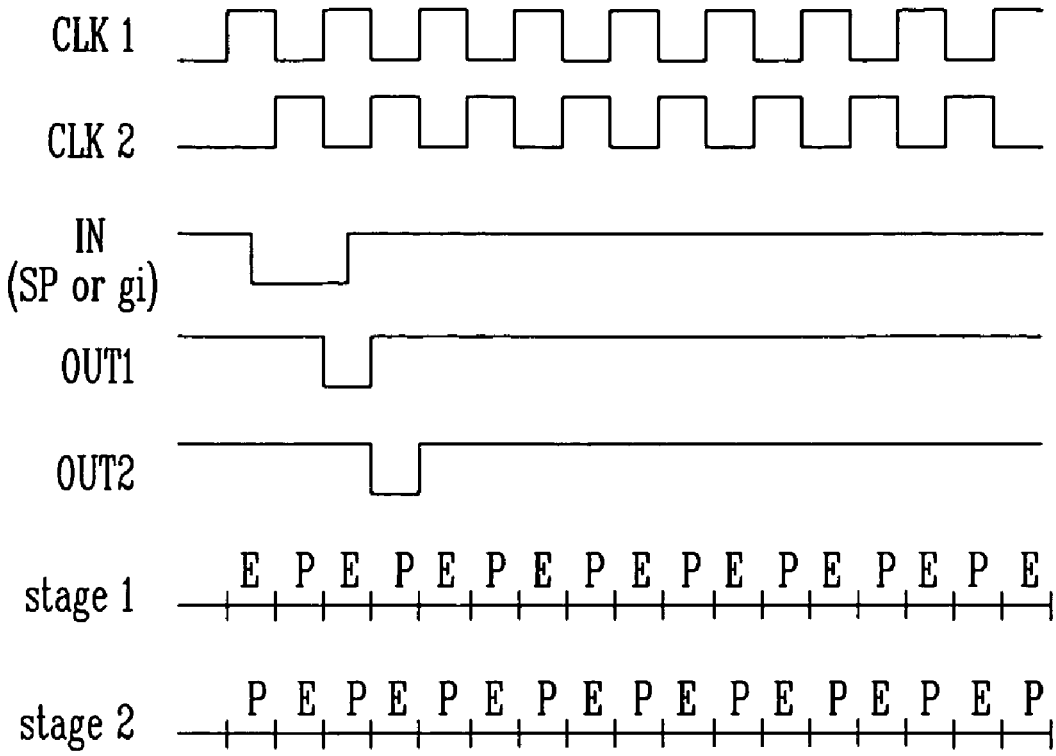
FIG. 7 is an input/output waveform diagram of the stages shown in FIG. 5.

FIG. 6 is a circuit diagram of a scan driving circuit according to a first embodiment of the present invention, which shows a detailed circuit arrangement of adjacent odd-numbered and even-numbered stages 601 and 602 in the scan driving circuit 10 of FIG. 5. FIG. 7 is an input/output waveform diagram of the stages shown in FIG. 6.

As shown in FIG. 6, the first embodiment of the present invention is realized with PMOS transistors. The PMOS transistors of each stage sequentially transfer a low-level output signal $g_i$ of a previous stage through a scan driving circuit, for example the scan driving circuit 10. That is, as shown FIG. 7, the scan driving circuit as described in the embodiments of the present invention outputs a high-level signal OUT1, OUT2 to the display region of an active matrix display device for most of the time, and sequentially outputs a low-level pulse or output signal $g_i$ through a plurality of stages. The notations OUT1 and OUT2 are used in this application to refer to both the output signal or output voltage and an output terminal or output line delivering the output signal or output voltage.

With reference to FIG. 6 and FIG. 7, one cycle of the input clock signals CLK1 and CLK2 is divided into first and second or precharge and evaluation time periods P, E. Each stage of the scan driving circuit performs a precharge operation during the precharge period P. The odd-numbered stages perform an evaluation operation that causes a pulse of a low level to be shifted by a half period of the input clock signal and outputted. Namely, the odd-numbered stages output a high-level signal during the precharge period P, and output a signal corresponding to an input received during the precharge period P during the evaluation period E.

Moreover, by coinciding the evaluation period E of the odd-numbered stages with the precharge period P of even-numbered stages, a low-level signal is sequentially transferred to all stages at time periods corresponding to a half period of the input clock signal.

In short, the output signal of each one of the stages includes a low level pulse. The low level pulse of each stage is sequentially shifted by half of the period of the input clock signals with respect to the pulse of a previous stage.

Also as FIG. 7 shows, the first clock signal CLK1 and the second clock signal CLK2 have phases that are inverted with respect to each other. As explained above, either of the first clock signal CLK1 or the second clock signal CLK 2 may be input to the first clock terminal CLKa or the second clock terminal CLKb depending on the stage. In each stage, if the first clock signal CLK1 is being input to the first clock terminal CLKa, then the second clock signal CLK2 is input to the second clock terminal CLKb and vice versa.

Hereinafter, operation of the stages will be explained in detail by reference to a circuit arrangement of an odd-numbered stage 601 according to a first embodiment of the invention that is shown in FIG. 6.

Referring to FIG. 6, the odd-numbered stage 601 includes a first PMOS transistor M1, a second PMOS transistor M2, a third PMOS transistor M3, a fourth PMOS transistor M4, a fifth PMOS transistor M5, a sixth PMOS transistor M6, a seventh PMOS transistor M7, and an eighth PMOS transistor M8. The first PMOS transistor M1 receives the start pulse SP, if the odd-numbered stage is the first stage, or the output voltage, also called the output signal $g_i$ of a previous stage, for other stages after the first stage. A gate terminal of the first PMOS transistor M1 is coupled with the first clock terminal CLKa which in the case of odd-numbered stages receives the first clock signal CLK1. The second PMOS transistor M2 is coupled with a first voltage source VDD as a first power supply source ELVDD and a first node N1. The first voltage source VDD may also be called a first power supply VDD. A gate terminal of the second transistor M2 is coupled with the first clock terminal CLKa receiving the first clock signal CLK1. The third PMOS transistor M3 is coupled between the second clock terminal CLKb receiving the second clock signal CLK2, and the first node N1. A gate terminal of the third transistor M3 is coupled with an output terminal of the first PMOS transistor M1. The fourth PMOS transistor M4 receives the output voltage or output signal $g_i$ of a previous stage or the first start pulse SP. A gate terminal of the fourth PMOS transistor M4 is coupled with the first clock terminal CLKa. The fifth PMOS transistor M5 is coupled with a second voltage source VSS as a second power supply source ELVSS and the second node N2, and a gate terminal of the fifth transistor M5 is coupled with the first clock terminal CLKa. The second voltage source VSS may also be called the second power supply VSS, and may be at ground level as shown. The sixth PMOS transistor M6 is coupled between the first clock terminal CLKa and the second node N2. A gate terminal of the sixth transistor M6 is coupled with an output terminal of the fourth PMOS transistor M4. The seventh PMOS transistor M7 is coupled between the second voltage source VSS and an output line OUT1 of the odd-numbered stage 601. A gate terminal of the seventh transistor M7 is coupled with the first node N1. The eighth PMOS transistor M8 is coupled between the first voltage source VDD and the output line OUT1, and a gate terminal of this transistor M8 is coupled with the second node N2. The second node N2 is located at the common output terminal of the fifth and sixth transistors M5, M6.

The odd-numbered stage 601 further includes a first capacitor C1, a second capacitor C2, a third capacitor C3, and a fourth capacitor C4. The first capacitor C1 is coupled between the output terminal of the first PMOS transistor M1 and the first node N1. The second capacitor C2 is coupled between the first node N1 and the second voltage source VSS. The third capacitor C3 is coupled between the output terminal of the fourth PMOS transistor M4 and the second voltage source VSS. The fourth capacitor C4 is coupled between the second node N2 and the second voltage source VSS.

The first and third capacitors C1 and C3 are data storage capacitors, whereas the second and fourth transistor C2 and C4 are precharge capacitors. The first, second, third, and fourth capacitors C1, C2, C3, and C4 can be embodied by connecting separate capacitors as shown or by using parasitic capacitance of the transistors.

As shown in FIG. 5, when the stage is an odd-numbered stage, a first clock signal CLK1 is supplied to the first clock terminal CLKa, and a second clock signal CLK2 is supplied to the second clock terminal CLKb. On the contrary, when the stage is an even-numbered stage, the second clock signal CLK2 is supplied to the first clock terminal CLKa, and the first clock signal CLK1 is supplied to the second clock terminal CLKb.

Furthermore, while in the circuit 601 of FIG. 6 the second voltage source VSS is shown as grounded, in an alternative embodiment a negative voltage may be applied to the second voltage source VSS.

Each stage includes a transfer unit 604, an inversion unit 606, and a buffer unit 608. The transfer unit 604 includes the first PMOS transistor M1, the second PMOS transistor M2, the third PMOS transistor M3, the first capacitor C1, and the second capacitor C2. The inversion unit 606 includes the fourth, fifth, and sixth PMOS transistors M4, M5, and M6 and the third and fourth capacitors C3 and C4. The buffer unit 608 includes the seventh and eighth PMOS transistors M7 and M8.

Assuming that the stage at issue is an odd-numbered stage, a time period when the first clock signal CLK1 has a low level but the second clock signal CLK2 has a high level becomes a precharge period P. A time period when the first clock signal CLK1 has a high level but the second clock signal CLK2 has a low level becomes an evaluation period E.

In operation of the odd-numbered stages, such as the odd-numbered stage 601, during the precharge period P, the first, second, fourth, fifth, and eighth PMOS transistors M1, M2, M4, M5, and M8 are turned-on, but the seventh transistor M7 is turned-off.

Accordingly, the first start signal SP or the output voltage of the previous stage, i.e., output signal $g_i$, is stored in the first and third capacitors C1 and C3 as the input signal IN. The precharge capacitor C2 of the transfer unit 604 is precharged to a high level, whereas the precharge capacitor C4 of the inversion unit is precharged to a low level, therefore, the output OUT1 of the buffer unit of the stage 601 goes to a high level.

In other words, in the transfer unit 604, as the second PMOS transistor M2 is turned-on, the precharge capacitor C2 is precharged to the voltage of the first voltage source VDD having a high level, thereby turning-off the seventh PMOS transistor M7. In the inversion unit 606, the fifth PMOS transistor M5 is turned-on, the precharge capacitor C4 is precharged to a ground voltage of low level, thereby turning-on the eighth PMOS transistor M8. Consequently, the buffer unit outputs a high level voltage equal to the voltage of the first voltage source VDD through the eighth PMOS transistor M8, with the result that the output OUT1 of the buffer unit goes to a high level.

In contrast, during the evaluation period E, the first, second, and fifth PMOS transistors M1, M2, and M5 are turned-off, and thus blocking the input signal IN, and the transfer unit 604, the inversion unit 606, and the buffer unit 608 accordingly perform an evaluation operation.

When the input signal IN received during the precharge period P (the first start pulse SP or the output voltage of a previous stage, i.e., the output signal $g_i$) is at a high level, both of the third and sixth transistors M3 and M6 are turned-off, the signal level precharged in the precharge capacitors C2 and C4 during the precharge period P is retained, as a result, the buffer unit outputs a high-level signal unchanged.

In contrast, when the input signal IN received during the precharge period P (the first start pulse SP or the output voltage of a previous stage, i.e., the output signal $g_i$) is at a low level, the third and sixth PMOS transistor M3 and M6 are turned-on. Accordingly, in the transfer unit 604, as the third PMOS transistor M3 is turned-on, a voltage precharged in the precharge capacitor C2 is reduced to a low level of the second clock signal CLK2 by a bootstrap operation. In the inversion unit 606, as the seventh PMOS transistor M7 is turned-on, a voltage precharged in the precharge capacitor C4 is increased to the high level of the first voltage source VDD.

Consequently, the seventh PMOS transistor M7 of the buffer unit 608 is turned-on but the eighth PMOS transistor M8 thereof is turned-off, and thus the buffer unit outputs a low-level voltage of the second clock signal CLK2 through the seventh PMOS transistor M7, with the result that the output OUT1 of the buffer unit goes to a low level.

That is, during the evaluation period E, when the input signal IN received during the precharge period, namely, the output voltage of a previous stage or a first start pulse, is at a low level, the transfer unit 604 outputs a low-level signal. When the received input signal IN is at a high level, the transfer unit 604 outputs a high-level signal. When the input signal IN received during the precharge period P, namely, an output voltage of a previous stage or a first start pulse, is at a low level, the inversion unit outputs a high-level signal. When the received input signal IN is at a high level, the inversion unit outputs a low-level signal.

The even-numbered stage 602 includes a transfer unit including transistors M9, M10, M11, and M15 and capacitors C5 and C6 and an inversion unit including transistors M12, M13, M14 and capacitors C7 and C8. The even-numbered stage 602 also includes a buffer unit including transistors M15 and M16. The components of the even-numbered stage 602 are connected together in substantially the same manner as the corresponding components of the odd-numbered stage 601, and the operation of the even-numbered stage 602 is substantially the same as the operation of the odd-numbered stage 601.

In the embodiment shown in FIG. 6, if each stage 601 includes only the transfer unit 604, the stage may perform an operation that shifts an input signal by a half time period of a clock signal. However, in that case, the scan driving circuit would have a problem in that it cannot drive a next stage to a high level during the evaluation period E.

In other words, when a plurality of stages are connected to one another, since the next stage 602 receives an input signal IN of the precharge period P during the evaluation period E of the current stage 601, in order to charge and discharge a data storage capacitor C5 of the transfer unit in the next stage 602, an electric current should flow through the output terminal OUT1 of the current stage 601 during the evaluation period E.

However, as noted previously, when the output of the transfer unit is at a high level during the evaluation period E, since an electric current does not flow through the transfer unit, rather the transfer unit maintains the voltage of the precharge capacitor C2, the transfer unit cannot drive a next stage in which a low-level signal is stored to a high level.

Therefore, in the first embodiment of the present invention, the stage 601 is embodied by a combination of the transfer unit 604 and the inversion unit 606. The transfer unit and the inversion unit provide the output terminal respectively with low and high levels during an evaluation period E. The buffer unit 608 functions to isolate the precharge capacitors C2 and C4 of the transfer unit and the inversion unit from other circuits.

In addition, referring to the input signal IN waveform shown in FIG. 7, to initialize a state of the stage 601, prior to applying an input signal IN of a low level to the stage 601, the input signal IN should initially maintain a high level, whereas the first and second clock signals CLK1 and CLK2 should initially maintain a low level.

As described above, when the input signal IN of a high level and the first and second clock signals CLK1, CLK2 of a low level are initially applied, the eighth and sixteenth transistors M8 and M16, functioning as pull-up switches, are turned-on and respectively output high-level signals OUT1, OUT2. The first, second, third, and fourth capacitors C1, C2, C3, and C4 are all discharged, thus completing the initialization for a normal operation.

Figure 8:
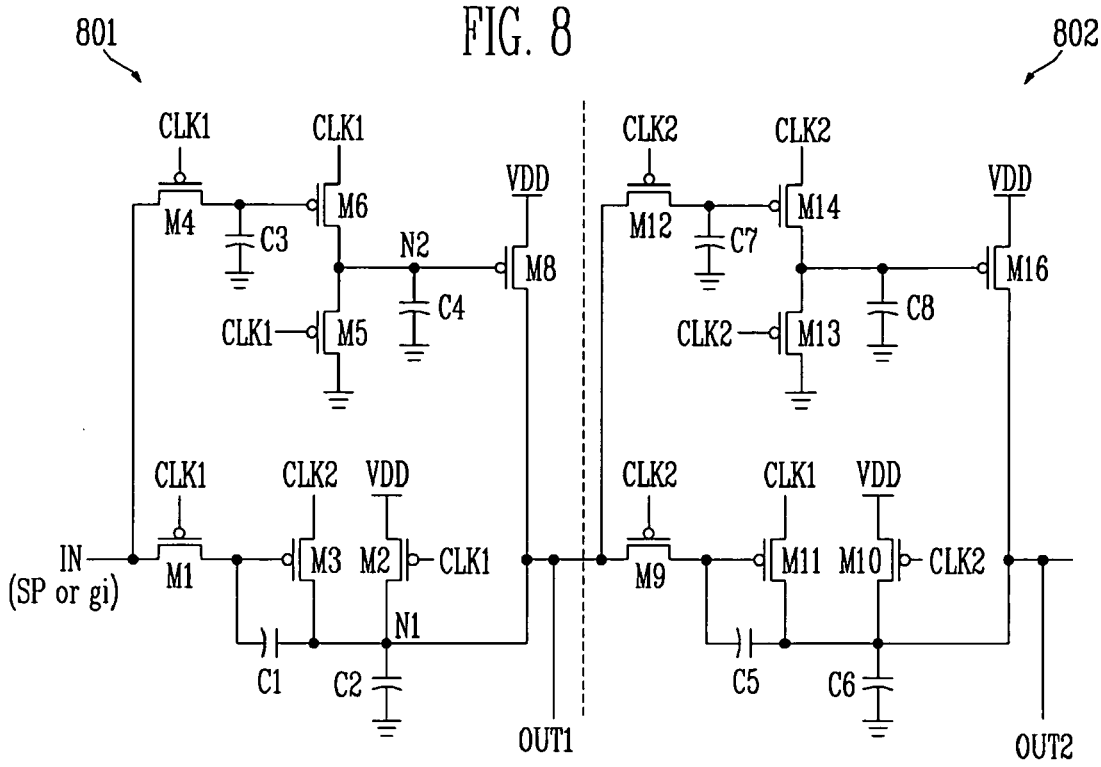
FIG. 8 is a circuit diagram showing odd and even stages of the scan driving circuit according to a second embodiment of the present invention.

FIG. 8 is a circuit diagram of the scan driving circuit according to a second embodiment of the present invention, which shows a detailed circuit arrangement of adjacent odd-numbered and even-numbered stages in the scan driving circuit 10 of FIG. 5.

Like or same elements to the elements used in the first embodiment of FIG. 6 are designated by the same reference numerals and labels, and a detailed description of these elements is omitted.

As shown in FIG. 8, the seventh PMOS transistor M7 is removed from the buffer unit of the odd-numbered stage 601 of the first embodiment to arrive at an odd-numbered stage 801 of the second embodiment.

The removal of the seventh PMOS transistor M7 is performed for switching an output voltage of each state to the range of voltage of the first voltage source VDD. In the circuit 601 of the first embodiment, a high level of the output voltage OUT1 is nearly identical with the voltage level of the first voltage source VDD but a low level of the output voltage OUT1 is set to be greater than a ground GND by a threshold voltage Vth of the seventh PMOS transistor M7. As a result, due to the characteristic deviation of a transistor, the low level of the output voltage of each stage can be different.

Furthermore, to obtain an output of a desired voltage range between VDD and GND, the voltage of the second voltage source VSS should be set to be lower than a ground GND by the threshold voltage Vth of the seventh transistor M7 in the circuit of the first embodiment 601.

In the second embodiment of the present invention, by removing the seventh PMOS transistor M7 of the odd-numbered stage and the fifteenth PMOS transistor M15 of an even-numbered stage from the circuits 601, 602 of the first embodiment, the second embodiment outputs a low-level voltage reduced to the ground GND by a bootstrap operation unchanged.

Figure 9:
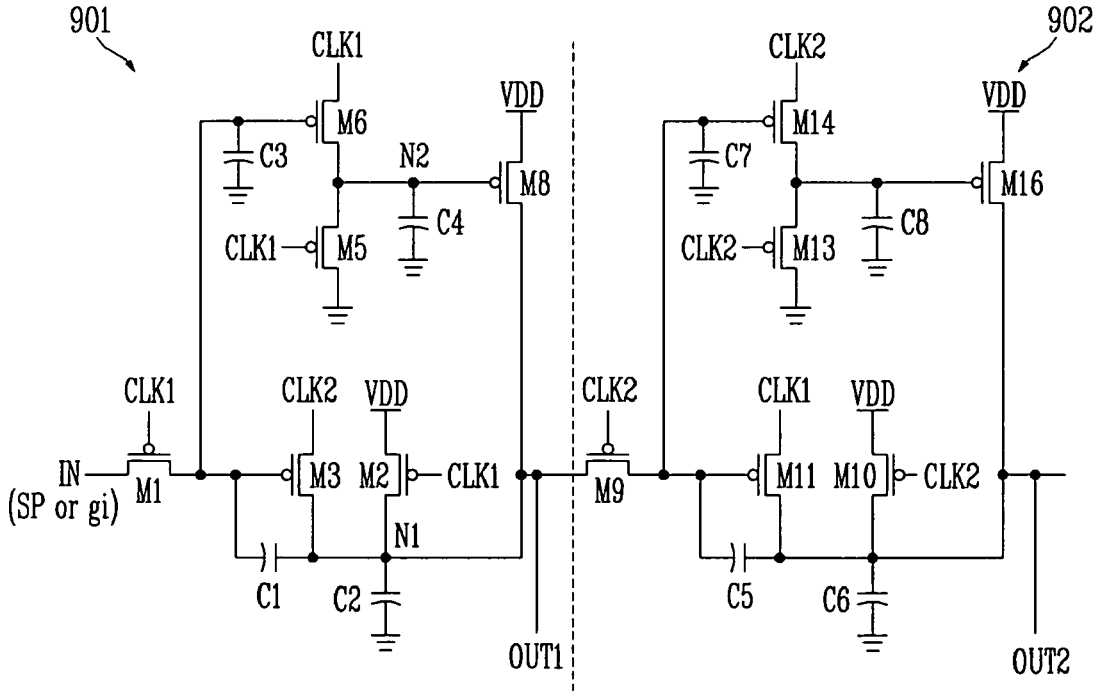
FIG. 9 is a circuit diagram showing odd and even stages of the scan driving circuit according to a third embodiment of the present invention.

FIG. 9 is a circuit diagram of odd and even stages of the scan driving circuit according to a third embodiment of the present invention, which shows a detailed circuit arrangement of adjacent odd-numbered and even-numbered stages in the scan driving circuit 10 of FIG. 5.

Like or same elements to the elements used in the first and second embodiments of FIG. 6 and FIG. 8 are designated by the same reference numerals and labels, and a detailed description of these elements is omitted.

As shown in FIG. 9, the third embodiment, like the second embodiment, removes the seventh PMOS transistor M7 of the odd-numbered stage 601 and the fifteenth PMOS transistor M15 of the even-numbered stage 602 of the first embodiment. Further, first and fourth transistors M1 and M4 and ninth and twelfth transistors M9 and M12 that are controlled by the same signal in the first and second embodiments, are integrated into one transistor in respectively an odd-numbered stage 901 and an even-numbered stage 902 of the third embodiment. In the third embodiment, the fourth and twelfth PMOS transistors M4 and M12 are removed, the gate terminal of the sixth PMOS transistor M6 is coupled to the output terminal of the first PMOS transistor M1, and a gate terminal of a fourteenth PMOS transistor M14 is coupled to the output terminal of the ninth PMOS transistor M9.

When the number of transistors receiving the input signal IN is reduced, as shown in FIG. 9, one side of the third capacitor C3 is connected to the first capacitor C1, and the other side of the third capacitor C3 is connected to ground GND. In this case, when the circuit having a construction mentioned above outputs a low-level signal, it performs a bootstrap operation by a voltage stored in the first capacitor C1. As the output voltage OUT1 is reduced, charge redistribution occurs between the first and third capacitors C1 and C3 that leads to a reduction in the voltage of the first capacitor C1. Therefore, in order to reduce voltage variation in the first capacitor C1, the third capacitor C3 may be removed or designed to have a smaller capacitance than the first capacitor C1.

If the third capacitor C3 is removed, the input signal IN is stored in the first capacitor C1. When the input signal IN is at high level, a voltage across the first capacitor C1 is 0V, and the eighth transistor M8 maintains the output terminal OUT1 of the odd-numbered stage 901 at a fixed high level, so that gate terminals of the third and sixth transistors M3 and M6 maintain a high level. In contrast, when the input signal IN is at low level, the output terminal OUT1 of the odd-numbered stage 901 is connected to the second clock terminal CLK2 through the third PMOS transistor M3, and the gate terminals of the third and sixth PMOS transistors M3 and M6 are concurrently bootstrapped.

When the gate terminal of the sixth transistor M6 is bootstrapped, an electric current flowing through the sixth transistor M6 is increased to charge the fourth capacitor C4. This causes a speed of turning-off the eighth PMOS transistor M8 to be increased and a speed of pulling-down the output terminal OUT1 is accordingly increased.

During a bootstrap operation, voltage of the first capacitor C1 is reduced by the third capacitor C3, and this causes a problem. In order to solve the problem, the terminal of the third capacitor C3 that is not connected to the first capacitor C1 and is shown in FIG. 9 as being grounded, may be instead connected to a power supply of a voltage lower than ground. However, in that case, an additional power supply is required.

Figure 10:
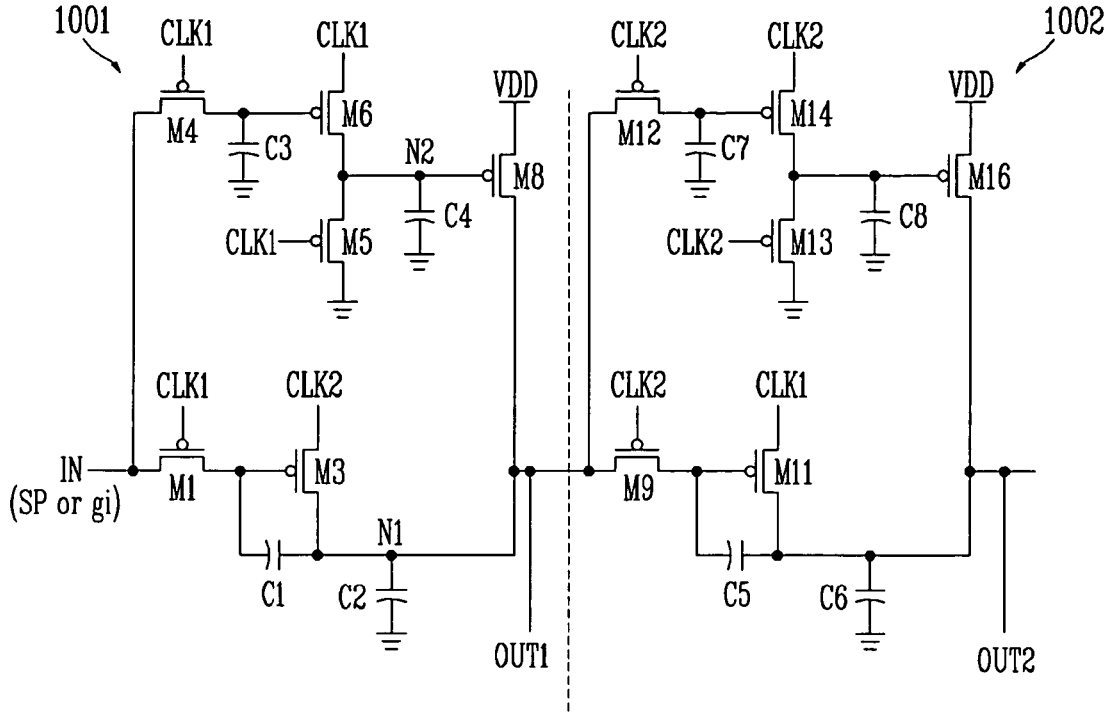
FIG. 10 is a circuit diagram showing odd and even stages of the scan driving circuit according to a fourth embodiment of the present invention.

FIG. 10 is a circuit diagram of the scan driving circuit according to a fourth embodiment of the present invention, which shows a detailed circuit arrangement of adjacent odd-numbered and even-numbered stages in the scan driving circuit 10 of FIG. 5.

Like or same elements to the elements used in the second embodiment of FIG. 8 are designated by the same reference numerals and labels, and a detailed description of these elements is omitted.

In the fourth embodiment shown in FIG. 10, in order to improve the asymmetrical switching speed of the second embodiment described in reference to FIG. 8, the second PMOS transistor M2 of the odd-numbered stage 801 and a tenth PMOS transistor M10 of the even-numbered stage 802 of the second embodiment are removed.

In the odd-numbered stage 801 of the second embodiment shown in FIG. 8, for example, the second and eighth PMOS transistors M2 and M8 are used as a pull-up switch for the output terminal OUT1, and the third PMOS transistor M3 is used as a pull-down switch for this terminal. Accordingly, a rising time of the output signal OUT1 is shorter than its falling time. In a case where the rising time of the output signal OUT1 is short, when the first and second clock signals CLK1 and CLK2 shown in FIG. 7 are used, while levels of the first and second clock signals CLK1 and CLK2 are changing, a low level signal being input to a next stage can be mistaken for a high level input signal.

Since a turn-on time of the eighth PMOS transistor M8 includes a turn-on time of the second PMOS transistor M2, the second PMOS transistor M2 is removed in the fourth embodiment of the present invention as shown in FIG. 10 in order to solve the aforementioned problem.

This way, when the second PMOS transistor M2 is removed, a source-gate voltage of the eighth PMOS transistor M8 at the time of pull-up becomes substantially identical to a source-gate voltage of the third PMOS transistor M3 at the time of pull-down, such that a substantially symmetrical switching speed can be obtained.

Figure 11:
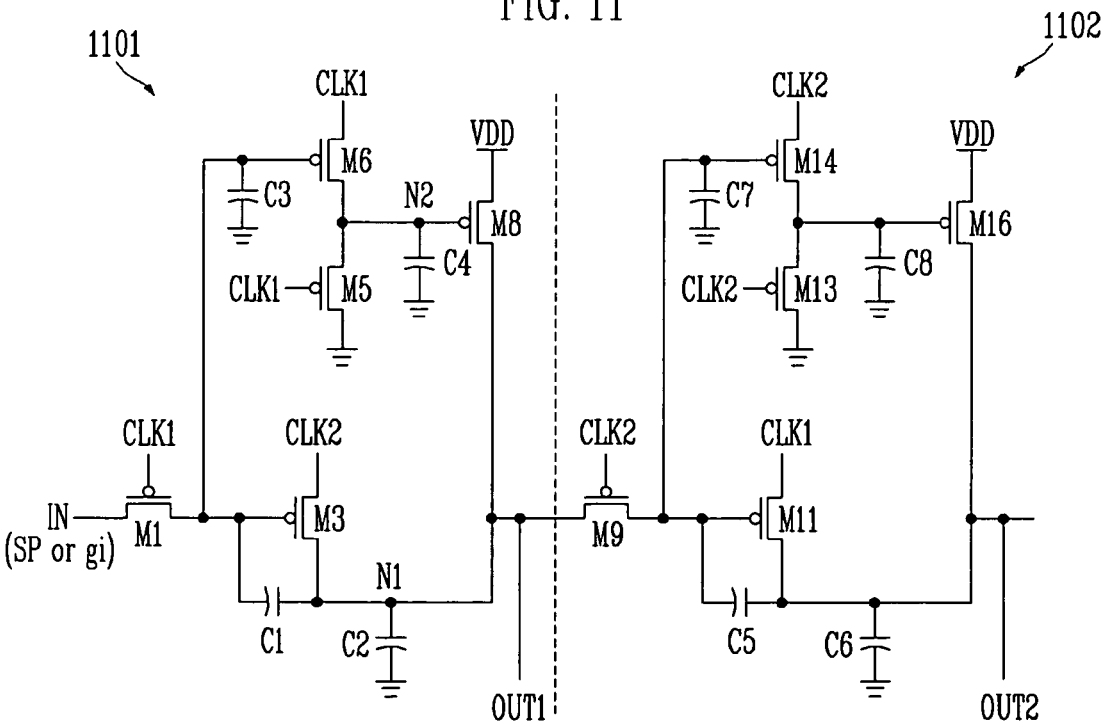
FIG. 11 is a circuit diagram showing odd and even stages of the scan driving circuit according to a fifth embodiment of the present invention.

FIG. 11 is a circuit diagram of the scan driving circuit according to a fifth embodiment of the present invention, which shows a detailed circuit arrangement of adjacent odd- and even-numbered stages in the scan driving circuit 10 of FIG. 5.

Like or same elements to the elements used in the third and fourth embodiments of FIG. 9 and FIG. 10 are designated by the same reference numerals and labels, and a detailed description of these elements is omitted.

As shown in FIG. 11, the fifth embodiment of the present invention is configured by a combination of the third and fourth embodiments respectively shown in FIG. 9 and FIG. 10.

Like the third and fourth embodiments, the fifth embodiment removes the seventh PMOS transistor M7 of the odd-numbered stage 601 and the fifteenth PMOS transistor M15 of the even-numbered stage 602 of the first embodiment. Further, the first and fourth PMOS transistors M1 and M4 of the odd-numbered stage of the fourth embodiment are controlled by the same signal and the ninth and twelfth transistors M9 and M12 of the even-numbered stage of the fourth embodiment are controlled by the same signal. Therefore, in the fifth embodiment, the two transistors in each pair are configured to be integrated into one, thereby causing the number of transistors for input to be reduced. In order to improve an asymmetrical switching speed, as in the fourth embodiment, the second PMOS transistor M2 of the odd-numbered stage and the tenth PMOS transistor M10 of the even-numbered stage, that were present in some of the other embodiments, are removed in the odd-numbered stage 1101 and the even-numbered stage 1102 of the fifth embodiment.

Figure 12:
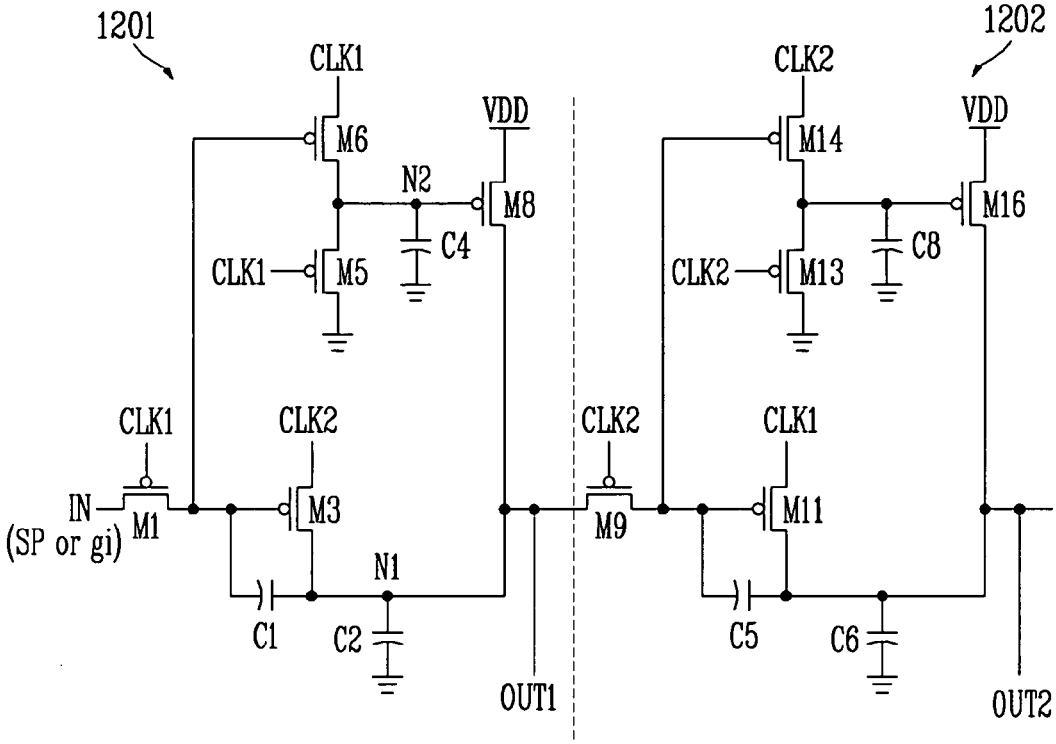
FIG. 12 is a circuit diagram showing odd and even stages of the scan driving circuit according to a sixth embodiment of the present invention.

FIG. 12 is a circuit diagram of the scan driving circuit according to a sixth embodiment of the present invention, which shows a detailed circuit arrangement of adjacent odd- and even-numbered stages in the scan driving circuit 10 of FIG. 5.

Like or same elements to the elements used in the fifth embodiment of FIG. 11 are designated by the same reference numerals and labels, and a detailed description of these elements is omitted.

To solve a problem due to a charge redistribution during a bootstrap operation in the fifth embodiment described in reference to FIG. 11, the sixth embodiment of the present invention shown in FIG. 12 removes the third capacitor C3 from the odd-numbered stage 1101 and a seventh capacitor C7 from the even-numbered stage 1102 of the fifth embodiment. Hence, an odd-numbered stage 1201 and an even-numbered stage 1202 of the sixth embodiment include fewer capacitors.

Figure 13:
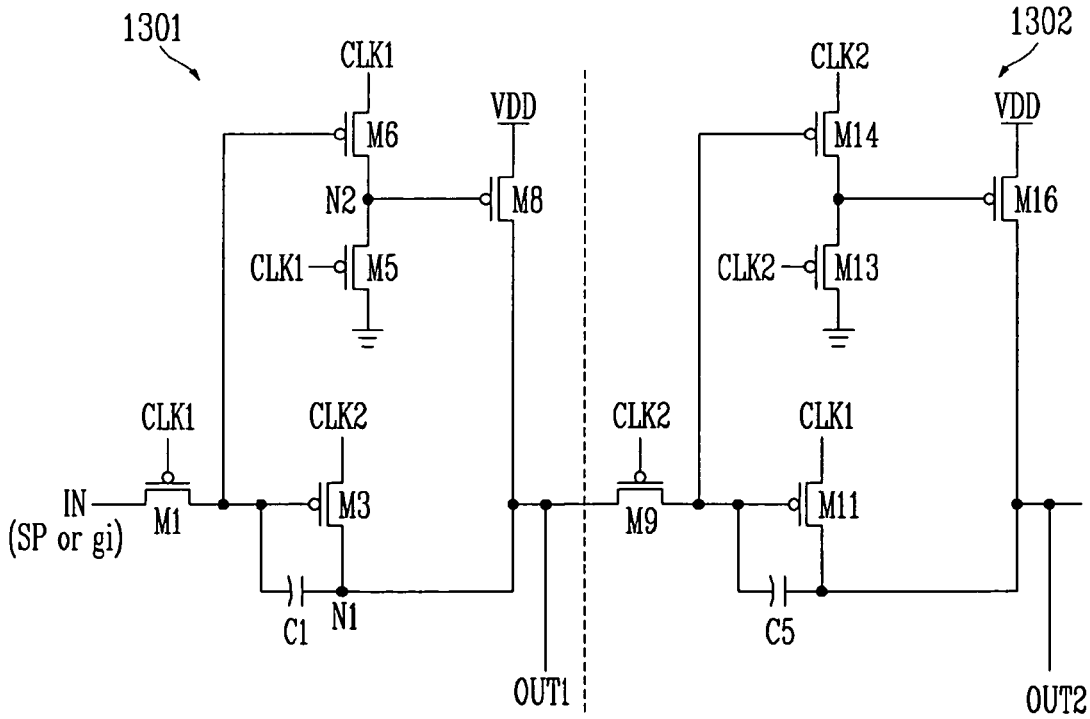
FIG. 13 is a circuit diagram showing odd and even stages of the scan driving circuit according to a seventh embodiment of the present invention.

FIG. 13 is a circuit diagram of the scan driving circuit according to a seventh embodiment of the present invention, which shows a detailed circuit arrangement of adjacent odd- and even-numbered stages in the scan driving circuit 10 of FIG. 5.

Like or same elements to the elements used in the sixth embodiment of FIG. 12 are designated by the same reference numerals and labels, and a detailed description of these elements is omitted.

In the seventh embodiment of the present invention shown in FIG. 13, the second and fourth capacitors C2 and C4 of the odd-numbered stage 1201 and sixth and eighth capacitors C6 and C8 of the even-numbered stage 1202 are removed from the sixth embodiment to arrive at an odd-numbered stage 1301 and an even-numbered stage 1302 of the seventh embodiment.

The second and sixth capacitors C2 and C6 are precharge capacitors included in the transfer units of odd and even-numbered stages, respectively, and the fourth and eighth capacitors C4 and C8 are precharge capacitors included in the inversion units of odd and even-numbered stages, respectively. In the seventh embodiment of the present invention, the precharge function of the capacitors C2, C4, C6, and C8 are achieved using parasitic capacitance of the transistors instead of using separate capacitors.

An exemplary odd-numbered stage 1301 of the scan driving circuit according to the seventh embodiment of the present invention includes the first PMOS transistor M1, the third PMOS transistor M3, the fifth PMOS transistor M5, the sixth PMOS transistor M6, and the eighth PMOS transistor M8. The first PMOS transistor M1 receives the first start pulse SP or the output voltage gi of a previous stage. A gate terminal of the first PMOS transistor M1 is coupled with the first clock terminal CLKa (refer to FIG. 5). The third PMOS transistor M3 is coupled between the second clock terminal CLKb (refer to FIG. 5) and an output line OUT1, and its gate terminal is coupled with the output terminal of the first PMOS transistor M1. The fifth PMOS transistor M5 is coupled between a second voltage source VSS that may be at ground voltage and the second node N2, and its gate terminal is coupled with the first clock terminal CLKa. The sixth PMOS transistor M6 is coupled between the first clock terminal CLKa and the second node N2, and its gate terminal is coupled with the output terminal of the first transistor M1. The eighth PMOS transistor M8 is coupled between the first voltage source VDD and the output line OUT1, and its gate terminal is coupled with the second node N2 which is a common connection between the fifth and sixth transistors M5, M6.

The odd-numbered stage 1301 further includes the first capacitor C1 coupled between the output terminal of the first PMOS transistor M1 and the output line OUT1.

An even-numbered stage 1302 of the seventh embodiment includes a similar structure. However, as shown in FIG. 13, when the stage is the odd-numbered stage 1301, a first clock signal CLK1 is supplied to the first clock terminal CLKa, and a second clock signal CLK2 is supplied to the second clock terminal CLKb. On the contrary, when the stage is the even-numbered stage 1302, the second clock signal CLK2 is supplied to the first clock terminal CLKa, and the first clock signal CLK1 is supplied to the second clock terminal CLKb.

Furthermore, a negative voltage may be supplied by the second voltage source VSS. Alternatively, the second voltage source VSS may be grounded as shown in FIG. 8. In an embodiment of the present invention, it is shown that the second voltage source VSS is grounded.

Each stage includes a transfer unit, an inversion unit, and a buffer unit. The transfer unit of the odd-numbered stage 1301 includes the first PMOS transistor M1, the third PMOS transistor M3, and the first capacitor C1. The inversion unit includes the fifth, and sixth PMOS transistors M5, and M6. The buffer unit includes the eighth transistor M8.

Assuming that the stage is an odd-numbered stage, a time period when the first clock signal CLK1 has a low level but the second clock signal CLK2 has a high level becomes a precharge period. A time period when the first clock signal CLK has a high level but the second clock signal CLK2 has a low level becomes an evaluation period. The seventh embodiment of FIG. 13 has functions similar to the first embodiment, and thus a detailed description of its operation is omitted.

Figure 14:
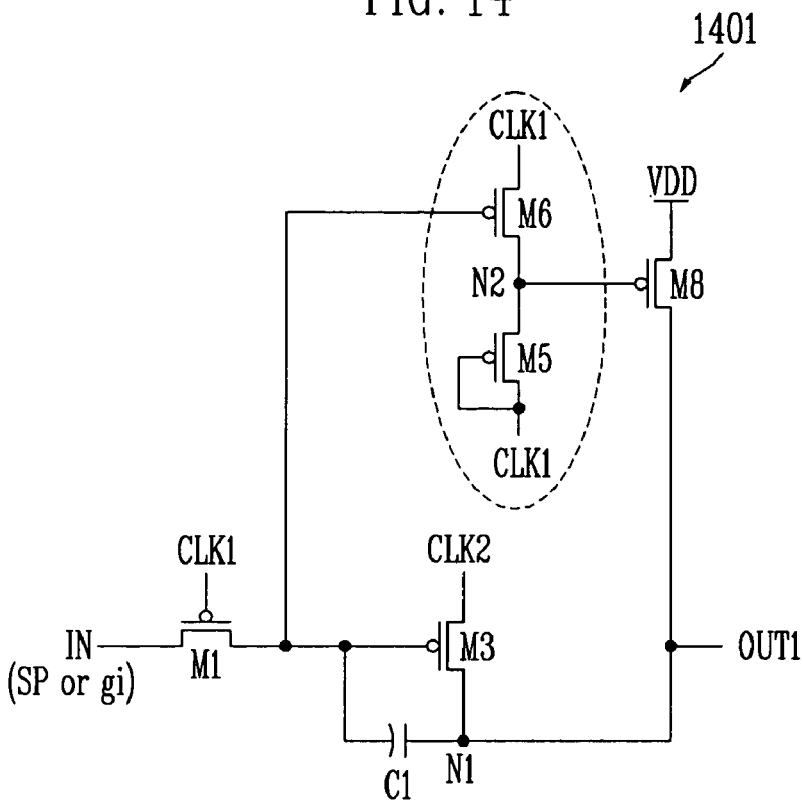
FIG. 14 is a circuitry diagram showing an odd-numbered stage of the scan driving circuit according to an eighth embodiment of the present invention.

FIG. 14 is a circuit diagram showing an odd-numbered stage of the scan driving circuit 10 according to an eighth embodiment of the present invention.

Like or same elements to the elements used in the seventh embodiment of FIG. 13 are designated by the same reference numerals and labels, and a detailed description of these elements is omitted.

In accordance with the eighth embodiment of the present invention shown in FIG. 14, a first clock terminal CLKa is connected to both the gate terminal and the output terminal of the fifth PMOS transistor M5 in the odd-numbered stage 1401 of the eighth embodiment.

In the seventh embodiment, each of the fifth and thirteenth transistors M5 and M13 is coupled between the second voltage source VSS and a second node N2, of its respective stage. The second node N2 is a common node connecting the fifth and thirteenth transistors M5, M13 to the output terminals of the sixth and fourteenth transistors M6, M14, respectively. The gate terminals of both the fifth and thirteenth transistors M5 and M13 are coupled to the first clock terminal CLKa. However, in the eighth embodiment, the gate terminal and the output terminal of the fifth transistor M5 are both coupled to the first clock terminal CLKa in common, and input terminal thereof is coupled to the second node N2. Although not shown in FIG. 14, the thirteenth transistor M13 is similarly treated in the eighth embodiment. In other words, the gate and one of the output terminals of the thirteenth transistor M13 are connected together and to the first clock terminal CLKa where they receive the second clock signal CLK2.

Figure 15:
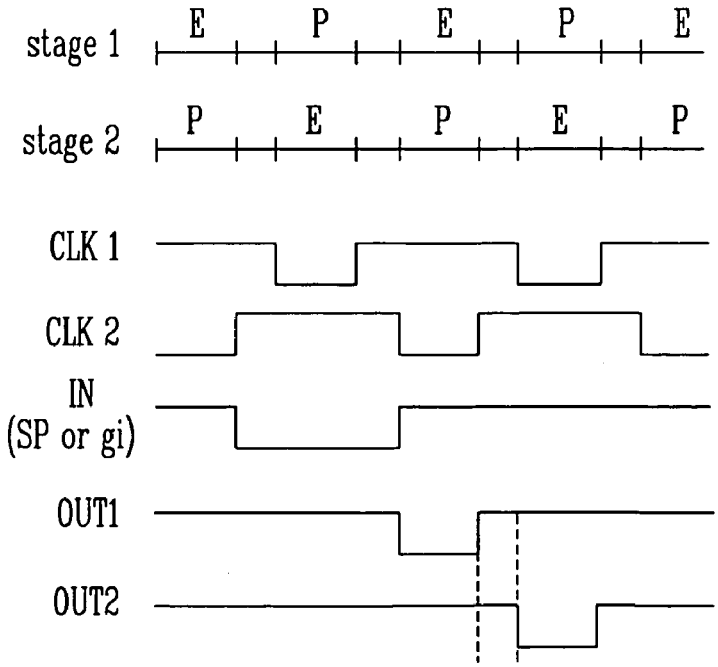
FIG. 15 is an alternative input/output waveform diagram of an odd-numbered stage and an even-numbered stage of a scan driving circuit according to an embodiment of the present invention.

FIG. 15 is an alternative input/output waveform diagram of a scan driving circuit according to an embodiment of the present invention.

With reference to FIG. 15, first and second clock signals CLK1, CLK2 being input to each stage are provided to overlap each other at a predetermined part of a high level portion of the signals.

In the second through eighth embodiments, when the pull-down transistor (the seventh transistor M7 of the odd-numbered stages and the fifteenth transistor M15 of the even-numbered stages) included in the buffer unit of each stage is removed, each stage outputs the first and second output signals OUT1 and OUT2 that are separated by time intervals corresponding to the period when the first and second clock signals CLK1 and CLK2 overlap at a high level.

The reason to have time intervals between output signals of each stage is to guarantee a margin for a clock skew or delay.

Operation of the scan driving circuit according to another embodiment of the present invention will be explained in reference to the alternative input/output waveform shown in FIG. 15 and the odd-numbered stage 801 of the second embodiment shown in FIG. 8.

In a case where the first and second clock signals CLK1 and CLK2 are both at high level, when a previous period is a precharge period P, precharge transistors M1, M2, M4, and M5 controlled by the first clock signal CLK1 are all turned-off, and evaluation transistors M3 and M6 maintain their previous state. Accordingly, voltages of precharge capacitors C1 and C2 remain unchanged, thereby maintaining the output OUT1 at its previous level. For example, in FIG. 15, a precharge period P of stage1 is followed by high levels for both CLK1 and CLK2. The output OUT1 of stage1 that has previously been at a high level continues to remain at a high level.

In contrast, when the previous period is an evaluation period E, the precharge transistors M1, M2, M4, and M5 are turned-off, the evaluation switch M3 maintains its previous state, and the evaluation transistor M6 is turned-off, so that a voltage of the capacitor C4 remains unchanged. When the evaluation transistor M3 is turned-off, the stage 801 of the scan driving circuit 10 receives a high-level input signal IN, with the result that the voltage of the capacitor C4 has a low level, and a high-level output OUT1 remains unchanged by an eighth transistor M8 being turned-on.

In contrast, when the evaluation transistor M3 is turned-on, the stage 801 of the scan driving circuit 10 receives a low-level input signal IN, the voltage of the capacitor C4 has a high level, and the eighth transistor M8 is turned-off. In addition, because the gate terminal of the transistor M3 is in a floating state, the voltage of the capacitor C1 remains unchanged, and thus the transistor M3 remains turned-on that causes an output OUT1 to go to a high level.

In short, in a case where the first and second clock signals CLK1 and CLK2 are both at high level, when a previous period is a precharge period P, the output OUT1 maintains its previous state. When the previous period is an evaluation period E, the output OUT1 has a high level. Consequently, a time interval between output pulses of adjacent stages may be reduced by an overlapping time of high levels of the first and second clock signals CLK1 and CLK2.

As apparent from the above description, in accordance with the described embodiment of the present invention, a flow path of a static current is removed from the scan driving circuit to reduce power consumption. Further, an output voltage can be switched from a positive power supply voltage to a negative power supply voltage using a bootstrap operation.

In addition, when the scan driving circuit outputs a high-level signal, an output terminal is not charged, thereby reducing or minimizing a leakage current. When the scan driving circuit outputs a low-level signal, the scan driving circuit performs a bootstrap operation, so that a reduction of an electric current charging the output terminal is reduced or minimized, such that the operation speed is increased.

Although certain exemplary embodiments of the present invention have been shown and described, it would be appreciated by those skilled in the art that changes might be made in this embodiment without departing from the principles and spirit of the invention, the scope of which is defined by the claims and their equivalents.

What is claimed is:

1. A scan driving circuit for an organic light emitting display device, the scan driving circuit comprising a plurality of stages coupled together in series, each stage coupled to an input line for receiving an input signal and an output line and being coupled to first and second power supplies, a first stage among the stages for receiving a start signal on the input line and each of the other stages having its input line coupled to the output line of a previous one of the stages having first and second clock terminals, each of the stages comprising:

a transfer unit having a first transistor and a second transistor, the first transistor having a first terminal coupled to the input line, a gate coupled to the first clock terminal, and a second terminal coupled to a gate of the second transistor, the second transistor having a first terminal coupled to the second clock terminal;

an inversion unit having a third transistor, a fourth transistor, and a fifth transistor, the third transistor having a first terminal coupled to the input line and a gate coupled to the first clock terminal, the fourth transistor having a second terminal coupled to the second power supply and a gate coupled with the first clock terminal, the fifth transistor having a first terminal coupled to the first clock terminal, a second terminal coupled to a first terminal of the fourth transistor, and a gate coupled to a second terminal of the third transistor; and a buffer unit having a sixth transistor, the sixth transistor having a first terminal coupled to the first power supply, a second terminal coupled to the output line, and a gate coupled to the second terminal of the fifth transistor.

2. The scan driving circuit of claim 1, wherein the transfer unit further comprises a seventh transistor coupled between the first power supply and a second terminal of the second transistor, the seventh transistor having a gate coupled with the first clock terminal.

3. The scan driving circuit of claim 1, wherein the buffer unit further comprises an eighth transistor coupled between the second power supply and the output line, and having a gate coupled with a second terminal of the third transistor.

4. The scan driving circuit of claim 1, wherein the transfer unit further comprises:

a first capacitor coupled between the second terminal of the first transistor and the second terminal of the second transistor; and a second capacitor coupled between the second terminal of the second transistor and the second power supply.

5. The scan driving circuit of claim 1, wherein the inversion unit further comprises:

a third capacitor coupled between the second terminal of the third transistor and the second power supply; and a fourth capacitor coupled between the second terminal of the fifth transistor and the second power supply.

6. The scan driving circuit of claim 3, wherein the first, second, third, fourth, fifth, sixth, seventh, and eighth transistors are PMOS transistors.

7. The scan driving circuit of claim 1, wherein the second power supply is grounded.

8. The scan driving circuit of claim 1, wherein a signal input to the first clock terminal and a signal input to the second clock terminal have phases inverted with respect to each other.

9. The scan driving circuit of claim 1, wherein a first clock signal is supplied to the first clock terminal and a second clock signal is supplied to the second clock terminal in an odd-numbered stage of the plurality of stages.

10. The scan driving circuit of claim 9, wherein a precharge operation is performed while the first clock signal is having a low level in the odd-numbered stage, and wherein an evaluation operation is performed while the first clock signal is having a high level in the odd-numbered stage.

11. The scan driving circuit of claim 1, wherein a second clock signal is supplied to the first clock terminal and a first clock signal is supplied to the second clock terminal in an even-numbered stage of the plurality of stages.

12. The scan driving circuit of claim 11, wherein a precharge operation is performed while the first clock signal is having a high level in the even-numbered stage, and wherein an evaluation operation is performed while the first clock signal is having a low level in the even-numbered stage.

13. The scan driving circuit of claim 10, wherein during a precharge period, an output signal of the odd-numbered stage has high-level, wherein during an evaluation period, the output signal has a level corresponding to an input signal received at the input line during the precharge period, and wherein the output signal includes a pulse of a low level sequentially shifted by a half period of the first clock signal.

14. The scan driving circuit of claim 1, wherein stages among the plurality of stages concurrently receiving the input signal having a high level and first and second clock signals having a low level are initialized.

* * * * *

UNITED STATES PATENT AND TRADEMARK OFFICE

CERTIFICATE OF CORRECTION

PATENT NO. : 7,639,217 B2
APPLICATION NO. : 11/513414
DATED : December 29, 2009
INVENTOR(S) : Dong Yong Shin et al.

It is certified that error appears in the above-identified patent and that said Letters Patent is hereby corrected as shown below:

| | |
|---|---|
| Title page, item (57) Abstract, line 2 | Delete "lock"<br>Insert -- clock -- |

Signed and Sealed this
Twentieth Day of December, 2011

David J. Kappos
*Director of the United States Patent and Trademark Office*